US009256170B1

(12) United States Patent
Kurita

(10) Patent No.: US 9,256,170 B1
(45) Date of Patent: Feb. 9, 2016

(54) IMAGE FORMING APPARATUS AND IMAGE FORMING METHOD WHICH ADJUST IMAGE MAGNIFICATION BASED ON SHEET SHRINKAGE

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Eizo Kurita, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/525,344

(22) Filed: Oct. 28, 2014

(51) Int. Cl.
*G03G 15/20* (2006.01)

(52) U.S. Cl.
CPC ..... *G03G 15/2017* (2013.01)

(58) Field of Classification Search
CPC ..... G03G 15/2017
USPC ..... 399/320, 69
See application file for complete search history.

(56) References Cited

U.S. PATENT DOCUMENTS

2009/0190941 A1* 7/2009 Hashimoto et al. ..... 399/43
2012/0224876 A1* 9/2012 Nakayama et al. ..... 399/69

* cited by examiner

*Primary Examiner* — Quana M Grainger
(74) *Attorney, Agent, or Firm* — Amin, Turocy & Watson, LLP

(57) ABSTRACT

In accordance with one embodiment, an image forming apparatus comprises a fixing device and a control section. The fixing device is provided with a fixing roller for conveying a sheet. The control section changes the rotation speed of the fixing roller based on a shrinkage rate of the sheet before and after the passing of the sheet through the fixing device. The control section changes, according to the shrinkage rate, the rotation speed of the fixing roller in the second and the following fixing processing carried out by the fixing device in a case in which the same sheet passes through the fixing device more than twice.

7 Claims, 6 Drawing Sheets

IMAGE FORMING APPARATUS AND IMAGE FORMING METHOD WHICH ADJUST IMAGE MAGNIFICATION BASED ON SHEET SHRINKAGE

FIELD

Embodiments described herein relate generally to an image forming apparatus and an image forming method.

BACKGROUND

There is an image forming apparatus which conveys a sheet-like medium (hereinafter collectively referred to as "sheet") such as paper and meanwhile forms an image on the sheet. The image forming apparatus is provided with a fixing device. The fixing device applies heat and pressure to the sheet to which the image is transferred to fix the image on the sheet. Thus, there is a possibility that the moisture contained in the sheet passing through the fixing device is evaporated, and as a result, the sheet is shrunk. The shrinkage degree of the sheet varies according to the category of the sheet. The shrunk sheet returns to the original size after a few minutes.

However, in a case of printing images on both sides of the sheet, there is a case in which the image is printed on the second surface before the sheet returns to the original size. As a result, when the sheet returns to the original size, the image printed on the second surface is stretched compared with the image printed on the first surface.

DETAILED DESCRIPTION

Figure 1:
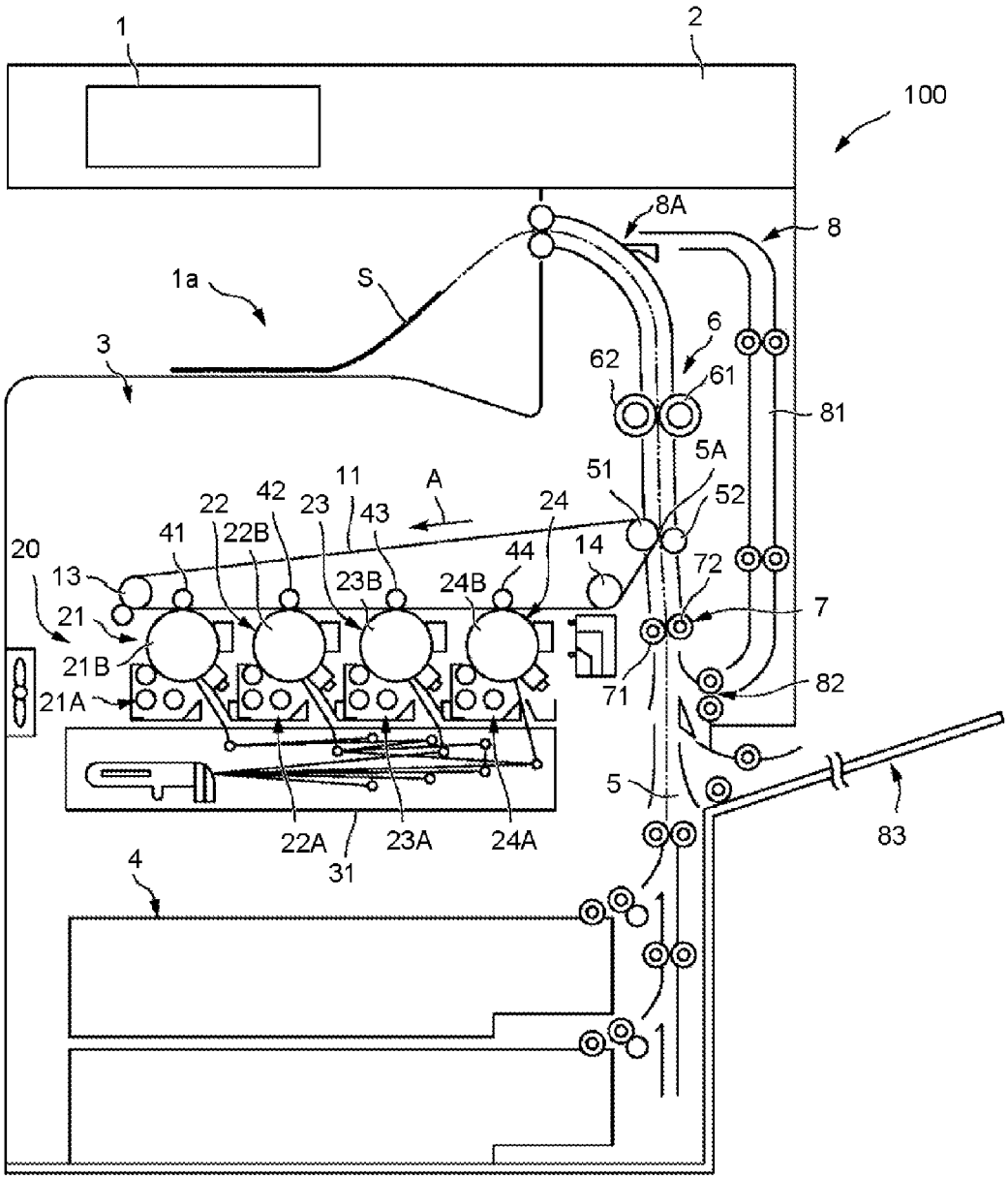
FIG. 1 is a schematic diagram illustrating an example of the whole constitution of an image forming apparatus according to one embodiment.

In accordance with one embodiment, an image forming apparatus comprises a fixing device and a control section. The fixing device is provided with a fixing roller for conveying a sheet. The control section changes the rotation speed of the fixing roller based on a shrinkage rate of the sheet before and after the passing of the sheet through the fixing device. The control section changes, according to the shrinkage rate, the rotation speed of the fixing roller in the second and the following fixing processing carried out by the fixing device in a case in which the same sheet passes through the fixing device more than twice.

Hereinafter, an image forming apparatus 100 according to the embodiment is described with reference to the accompanying drawings. The same components in each figure are applied with the same reference numerals.

FIG. 1 is a schematic diagram illustrating an example of the whole constitution of the image forming apparatus 100 according to the embodiment.

As shown in FIG. 1, the image forming apparatus 100 comprises a scanner section 2, a printer section 3 and a sheet housing section 4.

The scanner section 2 reads image information of a copy object as brightness and darkness of light and outputs the read image information to the printer section 3.

The printer section 3 transfers an output image to a sheet S based on the image information output from the scanner section 2. The sheet S is an image transferred medium. The output image is an output image (hereinafter referred to as a "toner image") visualized with developing agent such as toner and the like. The printer section 3 applies heat and pressure to the sheet S to which the toner image is transferred to fix the toner image on the sheet S.

The sheet housing section 4 respectively stores a plurality of sheets S of different given sizes for each size of the sheet S. The sheet housing section 4 supplies the sheet S one by one to the printer section 3 according to the timing when the toner image is formed in the printer section 3.

Between the sheet housing section 4 and the printer section 3 is arranged a conveyance path 5 which conveys the sheet S from the sheet housing section 4 to the printer section 3. A transfer position 5A exists on the conveyance path 5. The transfer position 5A is a position where the toner image formed in the printer section 3 is transferred to the sheet S. The sheet S is conveyed via the transfer position 5A towards a fixing device 6.

In the present embodiment, the upstream side of the flow of the sheet S conveyed on the conveyance path 5 is referred to as the upstream side of the conveyance path 5. The downstream side of the flow of the sheet S conveyed on the conveyance path 5 is referred to as the downstream side of the conveyance path 5.

The printer section 3 includes the fixing device 6, a register roller pair 7, a reversal unit 8, an intermediate transfer belt 11 and an image forming section 20.

The intermediate transfer belt 11 is arranged at a given position in the image forming apparatus 100. For example, the intermediate transfer belt 11 is arranged below the fixing device 6 in the vertical direction. For example, the intermediate transfer belt 11, which is an insulative film having a given thickness, is formed in a belt shape. The intermediate transfer belt 11 may also be a thin sheet-like metal the surface of which is protected with resin and the like.

A given tension is applied to the intermediate transfer belt 11 by a transfer driving roller 51, a first tension roller 13 and a second tension roller 14. When the transfer driving roller 51 is rotated, any position on the intermediate transfer belt 11 parallel to the axis of the transfer driving roller 51 is moved in a direction indicated by an arrow A. In other words, the belt surface of the intermediate transfer belt 11 is circulated in one direction at a speed equal to the speed of the movement of the outer peripheral surface of the transfer driving roller 51.

The image forming section 20 is arranged at a space where the belt surface of the intermediate transfer belt 11 is substantively moved in a plane in a state of being applied with the given tension.

The image forming section 20 includes image forming units 21, 22, 23 and 24 which are arranged between the first tension roller 13 and the second tension roller 14 at given intervals.

Each of the image forming units 21, 22, 23 and 24 includes a developing device 21A, 22A, 23A and 24A and a photoconductor 21B, 22B, 23B and 24B, respectively. Each developing device 21A, 22A, 23A and 24A stores toner of one color. For example, C (cyan), M (magenta), Y (yellow) and BK (black) toner is stored in the developing devices 21A, 22A, 23A and 24A, respectively.

An exposure device 31 is arranged at a position opposite to the photoconductors 21B, 22B, 23B and 24B. The exposure device 31 forms an electrostatic image corresponding to a color to be developed on the photoconductors 21B, 22B, 23B and 24B. The toner is selectively supplied by the developing devices 21A, 22A, 23A and 24A to the photoconductors 21B, 22B, 23B and 24B. In this way, the electrostatic images on the surfaces of the photoconductors 21B, 22B, 23B and 24B are developed with toner. As a result, toner images are formed on the surface of the photoconductors 21B, 22B, 23B and 24B.

Opposing rollers 41, 42, 43 and 44 are arranged at positions opposite to the photoconductors 21B, 22B, 23B and 24B across the intermediate transfer belt 11. Each of the opposing rollers 41, 42, 43 and 44 presses the intermediate transfer belt 11 against the photoconductors 21B, 22B, 23B and 24B. In this way, the toner images formed on the photoconductors 21B, 22B, 23B and 24B are transferred to the intermediate transfer belt 11. The toner images on the surfaces of the photoconductors 21B, 22B, 23B and 24B are sequentially transferred to the intermediate transfer belt 11 at given timing. The operation of transferring the toner image to the intermediate transfer belt 11 is referred to as "primary transfer" operation. The toner image of each color is formed on the intermediate transfer belt 11 through the primary transfer. The toner image of each color is overlapped at a given position of the surface of the intermediate transfer belt 11.

At the transfer position 5A arranged on the conveyance path 5 is arranged a transfer driven roller 52 which is contacted with the intermediate transfer belt 11 at a given pressure. The transfer driven roller 52 is pressed against the transfer driving roller 51 across the intermediate transfer belt 11.

Bias is applied between the transfer driving roller 51 and the transfer driven roller 52. In this way, the charged toner is moved towards the transfer driven roller 52 from the intermediate transfer belt 11. Thus, the toner image of each color overlapped on the surface of the intermediate transfer belt 11 is transferred to the sheet S from the intermediate transfer belt 11 at the transfer position 5A. The operation of transferring the toner image from the intermediate transfer belt 11 to the sheet S is referred to as "secondary transfer" operation.

In addition, in a case where the transfer of the toner image to the sheet S is not required, the transfer driven roller 52 is moved to a retracting position by a roller releasing mechanism (not shown). The retracting position is set to a position where the transfer driven roller 52 is not contacted with the intermediate transfer belt 11.

The register roller pair 7 is arranged at a given position on the conveyance path 5 from the sheet housing section 4 to the transfer position 5A. The register roller pair 7 includes a register driving roller 71 and a register driven roller 72. The register driving roller 71 is rotated in a given direction. The register driven roller 72 is pressed against the register driving roller 71 at a given pressure by a pressure mechanism (not shown). The sheet S conveyed from the sheet housing section 4 passes through the register roller pair 7 and then enters the transfer position 5A. The register roller pair 7 adjusts the conveyance direction of the sheet S which is to enter the transfer position 5A.

The sheet S conveyed from the sheet housing section 4 towards the transfer position 5A along the conveyance path 5 is temporarily stopped when abutting against the register roller pair 7. There is a case in which the sheet S is inclined when being conveyed from the sheet housing section 4 along the conveyance path 5. The sides of the inclined sheet S are not consistent with the conveyance direction perpendicular to the rotation axis of the register roller pair 7. In this case, the straight line of the front end of the sheet S is not parallel to the rotation axis of the register roller pair 7. The front end of the sheet S abuts against the register roller pair 7, in this way, the straight line of the front end of the sheet S becomes parallel to the rotation axis of the register roller pair 7. In this state, the register roller pair 7 nips the sheet S to correct the inclination of the sheet S in the conveyance direction.

The toner image is conveyed towards the transfer position 5A through the intermediate transfer belt 11. The register roller pair 7 is rotated again at the timing when the toner image reaches the transfer position 5A. The toner image is conveyed through the intermediate transfer belt 11 and reaches the transfer position 5A. The sheet S reaches the transfer position 5A at the timing when the toner image reaches the transfer position 5A. The sheet S is passed through the transfer position 5A to transfer the toner image to the sheet S.

The fixing device 6 applies heat and pressure to the toner image transferred to the sheet S. The toner image is fixed on the sheet S through the heat and pressure. The fixing device 6 includes a fixing driving roller 61 and a fixing driven roller 62. The fixing driving roller 61 rotates in a given direction. The fixing driven roller 62 is pressed against the fixing driving roller 61 at a given pressure by a pressure mechanism (not shown).

The sheet S on which the toner image is fixed by the fixing device 6 is guided to a sheet discharge section 1*a* along the conveyance path 5. The sheet discharge section 1*a* serves as one part of an exterior cover for covering the printer section 3. The sheet discharge section 1*a* is the space between the scanner section 2 and the cover.

At the downstream side of the fixing device 6 on the conveyance path 5 is arranged a branch point 8A which guides the sheet S in a direction different from the sheet discharge section 1*a*. In a case of carrying out printing on both sides of the sheet S, the sheet S is temporarily discharged towards the sheet discharge section 1*a*. Then the sheet S is drawn into the printer section 3 again. The sheet S is guided to the reversal unit 8 through the branch point 8A.

The reversal unit 8 conveys the sheet S along a conveyance path 81 in the reversal unit 8.

In the present embodiment, the upstream side of the flow of the sheet S conveyed on the conveyance path 81 is referred to as the upstream side of the conveyance path 81. The downstream side of the flow of the sheet S conveyed on the conveyance path 81 is referred to as the downstream side of the conveyance path 81.

A reversal unit register roller pair 82 is arranged in the reversal unit 8.

Similar to the register roller pair 7, the reversal unit register roller pair 82 temporarily stops the sheet S conveyed on the conveyance path 81. In this way, the inclination of the sheet S is corrected. Further, the reversal unit register roller pair 82 restarts the conveyance of the sheet S at the timing when the toner image reaches the transfer position 5A. The sheet S conveyed from the reversal unit register roller pair 82 is merged with the conveyance path 5.

On the conveyance path 5, there is a position where the sheet S discharged from the reversal unit register roller pair 82 is merged with the conveyance path 5. The sheet S is inserted to the conveyance path 5 from a manual feeding tray 83 at the upstream side of the position where the sheet S is merged with the conveyance path 5.

Figure 2:
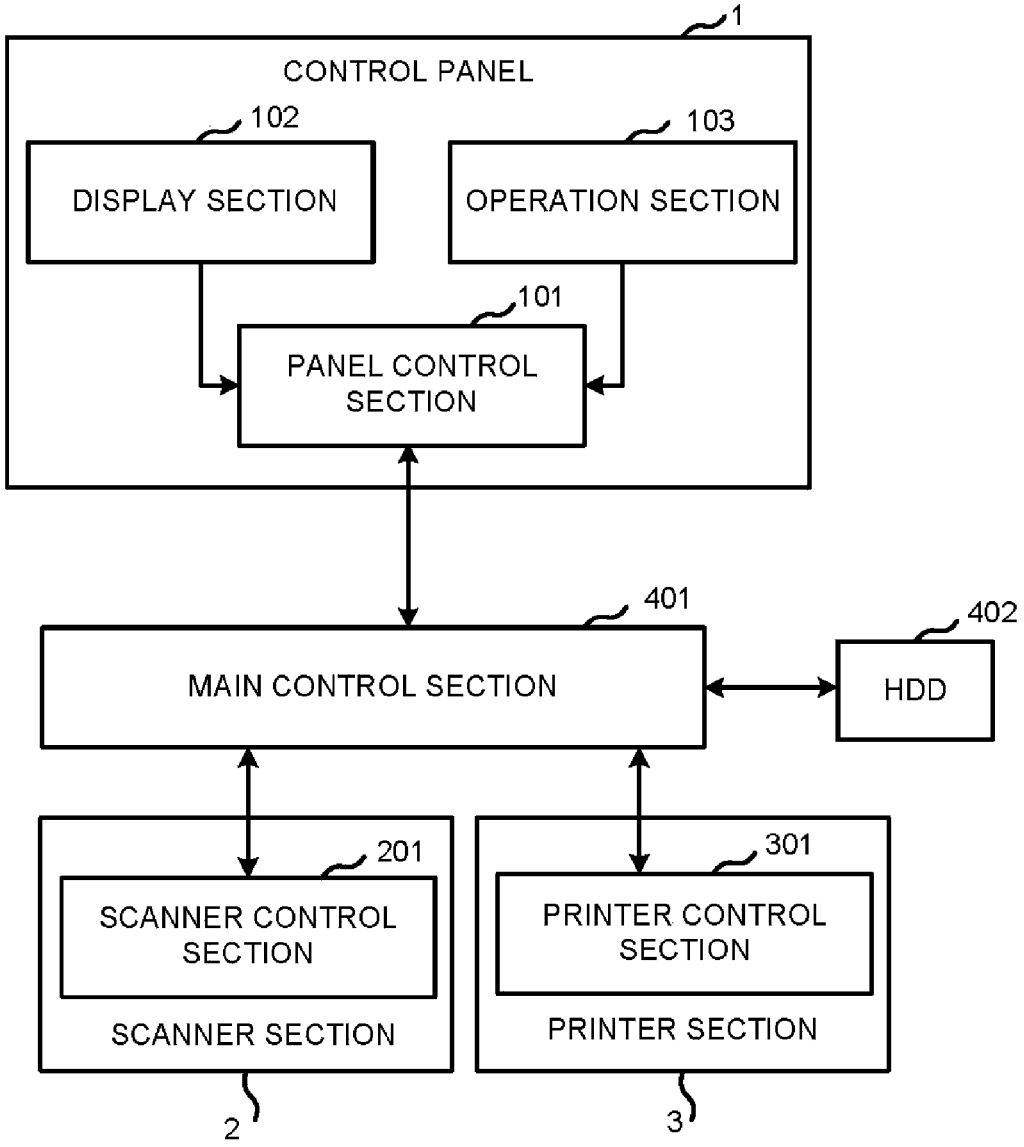
FIG. 2 is a block diagram illustrating an example of the constitution of the image forming apparatus.

Next, the constitution of the image forming apparatus 100 is described with reference to FIG. 2. FIG. 2 is a block diagram illustrating an example of the constitution of the image forming apparatus 100.

A control panel 1 and the scanner section 2 and the printer section 3 described above are connected with a main control section 401. The main control section 401 controls the whole operations of the image forming apparatus 100. The main control section 401 is connected with an HDD (Hard Disk Drive) 402. The main control section 401 includes a CPU (Central Processing Unit), an ROM (read only memory) and an RAM (Random Access Memory).

The HDD 402, which is a memory such as a semiconductor storage device, a magnetic storage device and the like, stores programs and the like for operating the main control section 401.

The control panel 1 includes a panel control section 101, a display section 102 and an operation section 103. The panel control section 101, which consists of a CPU, an ROM and an RAM, controls the control panel 1.

The display section 102 outputs a screen corresponding to the operation content or an image corresponding to an instruction from the main control section 401.

The operation section 103, which includes various keys, receives an operation from a user, and outputs a signal indicating the operation content to the panel control section 101.

The display section 102 and the operation section 103 may be integrally arranged as a touch panel type display.

In the present embodiment, the main control section 401 displays various settings such as the number of printings, the size and the category of the sheet S, and the like on the display section 102. The operation section 103 receives a designation and a change of the setting. For example, information relating to the setting is displayed on the display section 102. For example, the information indicating the category of the sheet S is designated through the operation section 103. The operation section 103 outputs the information indicating the designated category of the sheet S to a printer control section 301. The printer control section 301 writes the designated category of the sheet S in the RAM arranged inside. In a case in which the sheet S is of a standard size, the size of the sheet S is pre-determined according to the set category of the sheet S. The size of the sheet S corresponding to the category of the sheet S is stored in the RAM arranged inside the printer control section 301.

The scanner section 2 is provided with a scanner control section 201. The scanner control section 201, which includes a CPU, an ROM and an RAM, controls the scanner section 2 to read image information.

The printer section 3 is provided with a printer control section 301. The printer control section 301, which includes a CPU, an ROM and an RAM, controls the printer section 3 to print an image on the sheet S.

Figure 3:
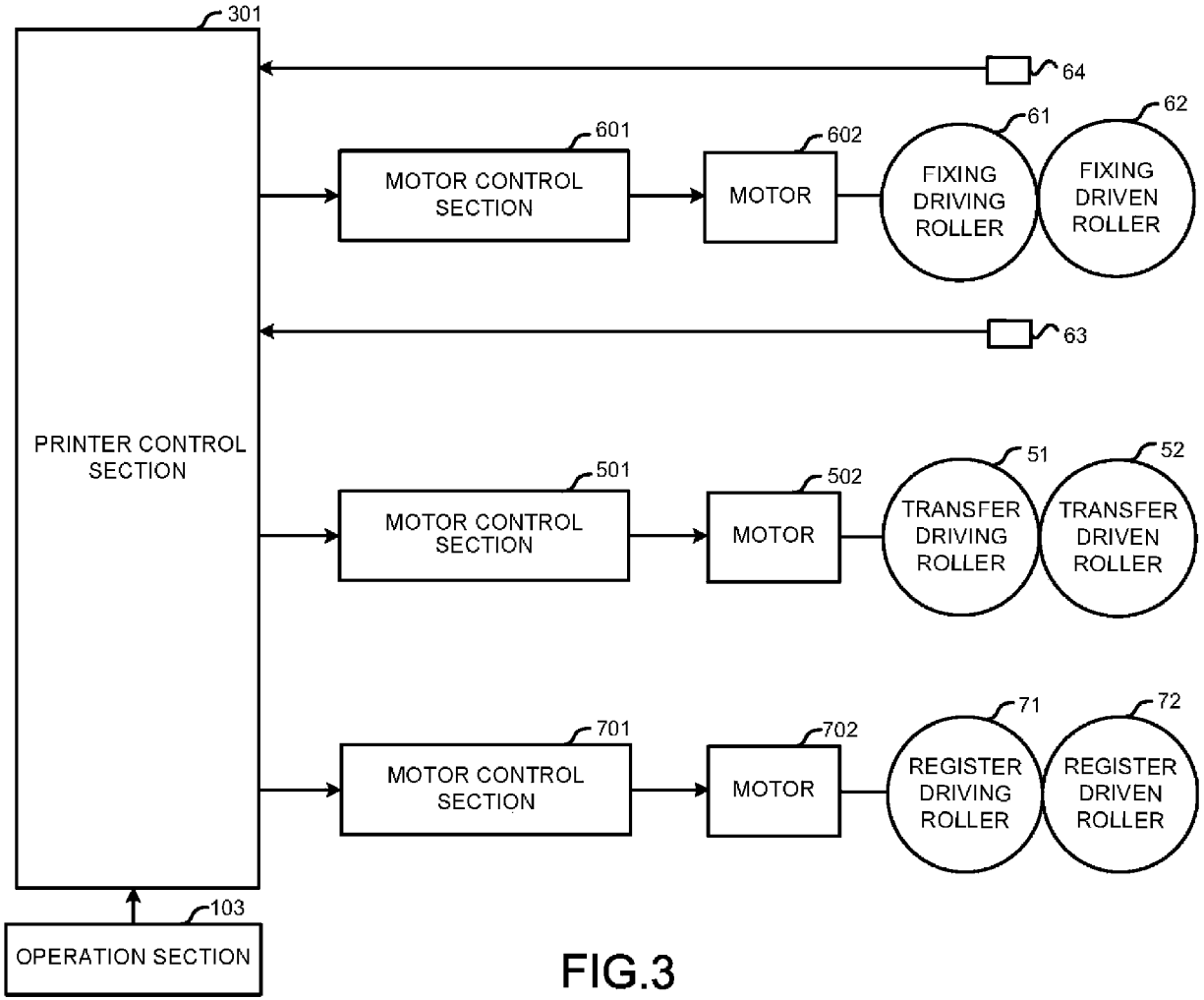
FIG. 3 is a block diagram illustrating an example of the constitution of one part of the image forming apparatus.

Next, the constitution of one part of the image forming apparatus 100 is described in detail with reference to FIG. 3. FIG. 3 is a block diagram illustrating an example of the constitution of one part of the image forming apparatus 100.

As shown in FIG. 3, the fixing driving roller 61 is connected with a motor 602. The motor 602 is connected with a motor control section 601. The motor control section 601 is connected with the printer control section 301. The motor control section 601 rotates the motor 602 at a designated rotation speed. The rotation speed is instructed through the printer control section 301. The fixing driving roller 61 is rotated along with the rotation of the motor 602. The movement of the fixing driving roller 61 is transmitted to the fixing driven roller 62, thus, the fixing driven roller 62 rotates in a direction opposite to that of the fixing driving roller 61.

A pre-fixing sensor 63 is arranged at the upstream side of a nip portion (hereinafter referred to as a "fixing position") between the fixing driving roller 61 and the fixing driven roller 62. A post-fixing sensor 64 is arranged at the downstream side of the fixing position.

The pre-fixing sensor 63 and the post-fixing sensor 64 output an ON signal to the printer control section 301 if the passing sheet S is detected. On the other hand, the pre-fixing sensor 63 and the post-fixing sensor 64 may output an OFF signal to the printer control section 301 if the passing sheet S is not detected. The printer control section 301 calculates the sheet passing time of the sheet S based on the ON signal input from the pre-fixing sensor 63 and the post-fixing sensor 64.

The transfer driving roller 51 is connected with a motor 502. The motor 502 is connected with a motor control section 501. The motor control section 501 is connected with the printer control section 301. The motor control section 501 rotates the motor 502 at a designated rotation speed. The rotation speed is instructed through the printer control section 301. The transfer driving roller 51 is rotated along with the rotation of the motor 502. The movement of the transfer driving roller 51 is transmitted to the transfer driven roller 52, thus, the transfer driven roller 52 rotates in a direction opposite to that of the transfer driving roller 51.

The register driving roller 71 is connected with a motor 702. The motor 702 is connected with a motor control section 701. The motor control section 701 is connected with the printer control section 301. The motor control section 701 rotates the motor 702 at a designated rotation speed. The rotation speed is instructed through the printer control section 301. The register driving roller 71 is rotated along with the rotation of the motor 702. The movement of the register driving roller 71 is transmitted to the register driven roller 72, thus, the register driven roller 72 rotates in a direction opposite to that of the register driving roller 71.

Figure 4:
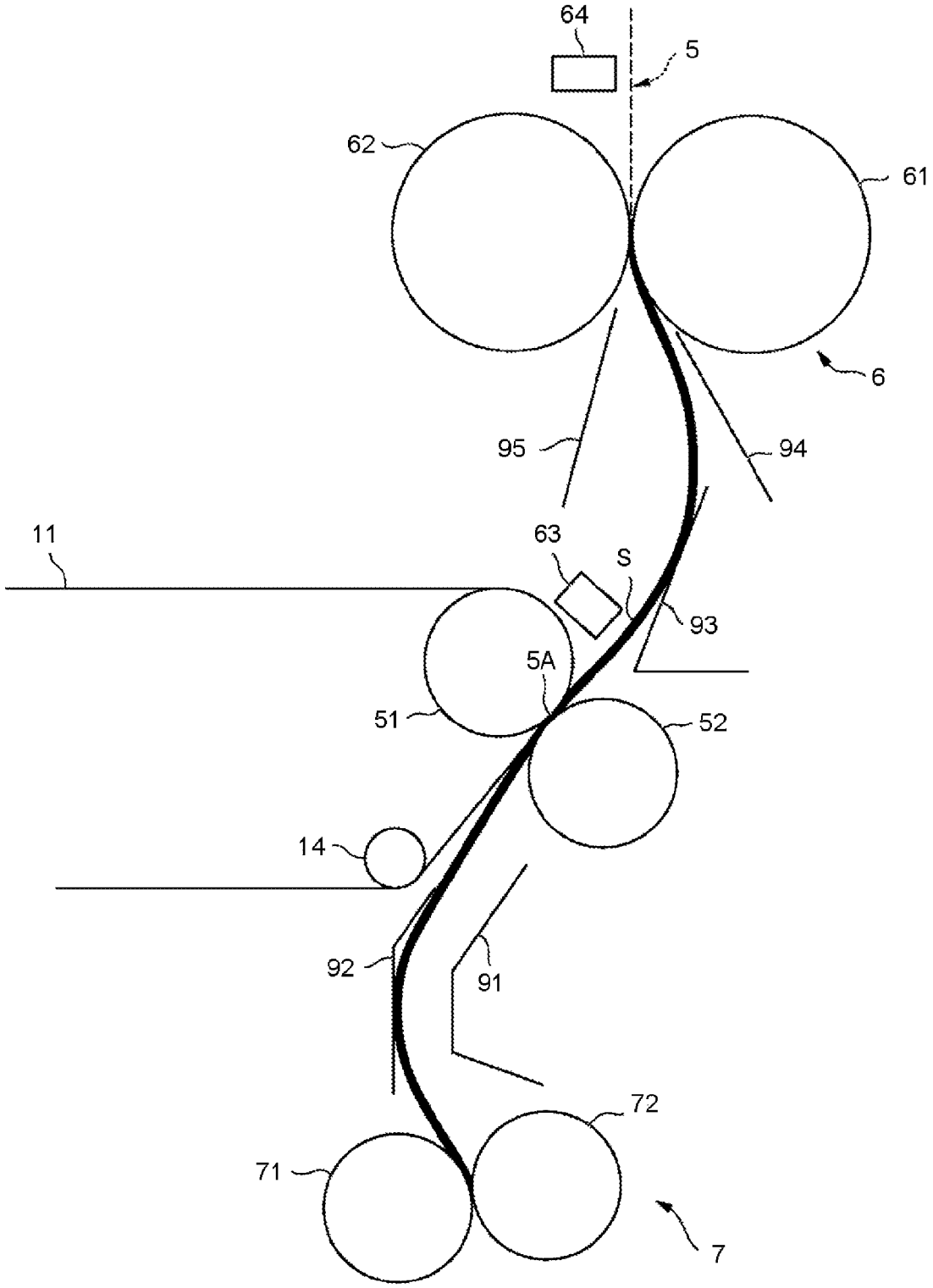
FIG. 4 is a block diagram illustrating part of the constitution nearby a transfer position in the image forming apparatus.

Next, the constitution nearby the transfer position 5A in the image forming apparatus 100 is described with reference to FIG. 4. FIG. 4 is a block diagram illustrating part of the constitution nearby the transfer position 5A in the image forming apparatus 100.

The sheet S shown in FIG. 4 is in a state of being conveyed on the conveyance path 5. In the example shown in FIG. 4, the sheet S exists on the conveyance path 5 from the register roller pair 7 to the fixing device 6.

A guide 91 and a guide 92 are arranged on the conveyance path 5 from the register roller pair 7 to the transfer position 5A to regulate the bulge of the sheet S. The guide 91 is arranged at the right side of the conveyance path 5 in FIG. 4, and the guide 92 is arranged at the left side of the conveyance path 5 in FIG. 4.

A guide 93, a guide 94 and a guide 95 are arranged on the conveyance path 5 from the transfer position 5A to the fixing device 6 to regulate the bulge of the sheet S. The guide 93, which is arranged at the upstream side of the guide 94, and the guide 94 are arranged at the right side of the conveyance path 5 in FIG. 4, and the guide 95 is arranged at the left side of the conveyance path 5 in FIG. 4.

The sheet S which is nipped by the fixing device 6 and is nipped between the intermediate transfer belt 11 and the transfer driven roller 52 is deflected. If the conveyance speed of the sheet S by the fixing device 6 is slowed down, the deflection amount of the sheet S is increased. Particularly, in a case in which the sheet S is a tough, thick paper and the like, when the deflection amount is increased, a force that presses the sheet S towards the direction of the transfer position 5A is generated. In this case, the conveyance speed of the sheet S at the transfer position 5A is slowed down due to the force.

If the conveyance speed of the sheet S serving as a transfer destination at the transfer position 5A is slower than the rotation speed of the intermediate transfer belt 11 serving as a transfer source, the image transferred to the sheet S is shrunk. That is, when the conveyance speed of the sheet S by the fixing device 6 is slowed down, the conveyance speed of the sheet S at the transfer position 5A is slowed down as well, in this way, the image transferred to the sheet S at the transfer position 5A is shrunk.

Figure 5:
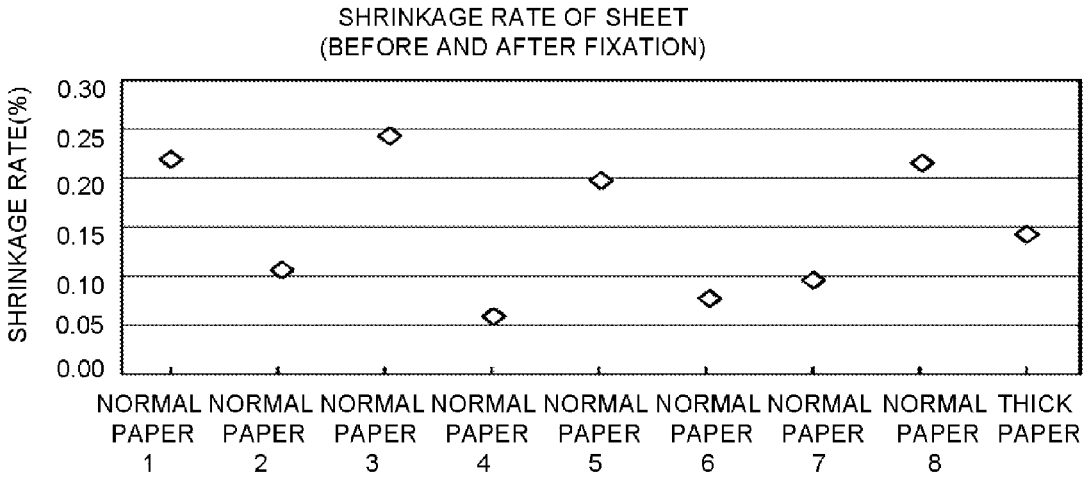
FIG. 5 is a diagram illustrating examples of shrinkage rates due to thermal shrinkage corresponding to sheets.

Herein, examples of shrinkage rates of the sheets S due to the thermal shrinkage of the sheets S by the fixing device 6 are described with reference to FIG. 5. FIG. 5 is a diagram illustrating examples of the shrinkage rates due to thermal shrinkage corresponding to the sheets S.

FIG. 5 is a graph illustrating the shrinkage rates before and after fixation by the fixing device 6 for each category of the sheet S. As shown in FIG. 5, the shrinkage degree of the sheet varies according to the category of the sheet S. In the example shown in FIG. 5, the sheet S shrinks in a range of 0.05%-0.25%. In addition, the shrinkage rate of thick paper is 0.15%.

Figure 6:
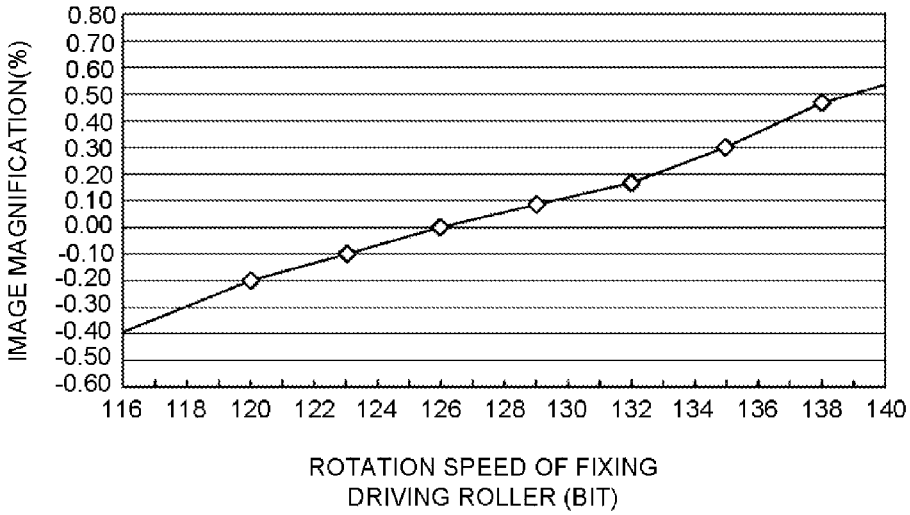
FIG. 6 is a diagram illustrating an example of the relation between a fixing speed and an image magnification.

Next, the relation between the rotation speed (fixing speed) of the fixing device 6 and the image magnification is described with reference to FIG. 6. FIG. 6 is a diagram illustrating an example of the relation between the fixing speed and the image magnification. In addition, the speed change rate is 0.075% per BIT.

In a case in which the fixing driving roller 61 rotates at 126 BIT, the image magnification is 0.00%. That is, in a case in which the fixing driving roller 61 rotates at 126 BIT, the image printed on the second surface is not magnified or shrunk.

On the other hand, in a case in which the fixing driving roller 61 rotates at 120 BIT, the image magnification is −0.20%. That is, in a case in which the fixing driving roller 61 rotates at 120 BIT, the image printed on the second surface is shrunk.

In a case in which the fixing driving roller 61 rotates at 132 BIT, the image magnification is +0.18%. That is, in a case in which the fixing driving roller 61 rotates at 132 BIT, the image printed on the second surface is magnified.

In this way, when the rotation speed of the fixing driving roller 61 is slowed down, the image printed on the second surface is shrunk. When the rotation speed of the fixing driving roller 61 is speeded up, the image printed on the second surface is magnified. The magnification and the shrinkage rate of the image are generally proportional to the rotation speed of the fixing driving roller 61.

The shrinkage rate of the sheet S corresponding to the conveyance speed of the sheet S by the fixing device 6 is determined in advance based on the relation between the fixing speed and the image magnification shown in FIG. 6. The printer control section 301 stores the information indicating the shrinkage rate of the sheet S corresponding to the conveyance speed of the sheet S by the fixing device 6. For example, the printer control section 301 includes a shrinkage rate table in which the rotation speed of the fixing driving roller 61 is associated with the shrinkage rate. The printer control section 301 determines the rotation speed corresponding to the shrinkage rate by reference to the shrinkage rate table. Further, the printer control section 301 may store a calculating formula for calculating the rotation speed corresponding to the shrinkage rate. The printer control section 301 calculates the rotation speed corresponding to the shrinkage rate based on the calculating formula.

Figure 7:
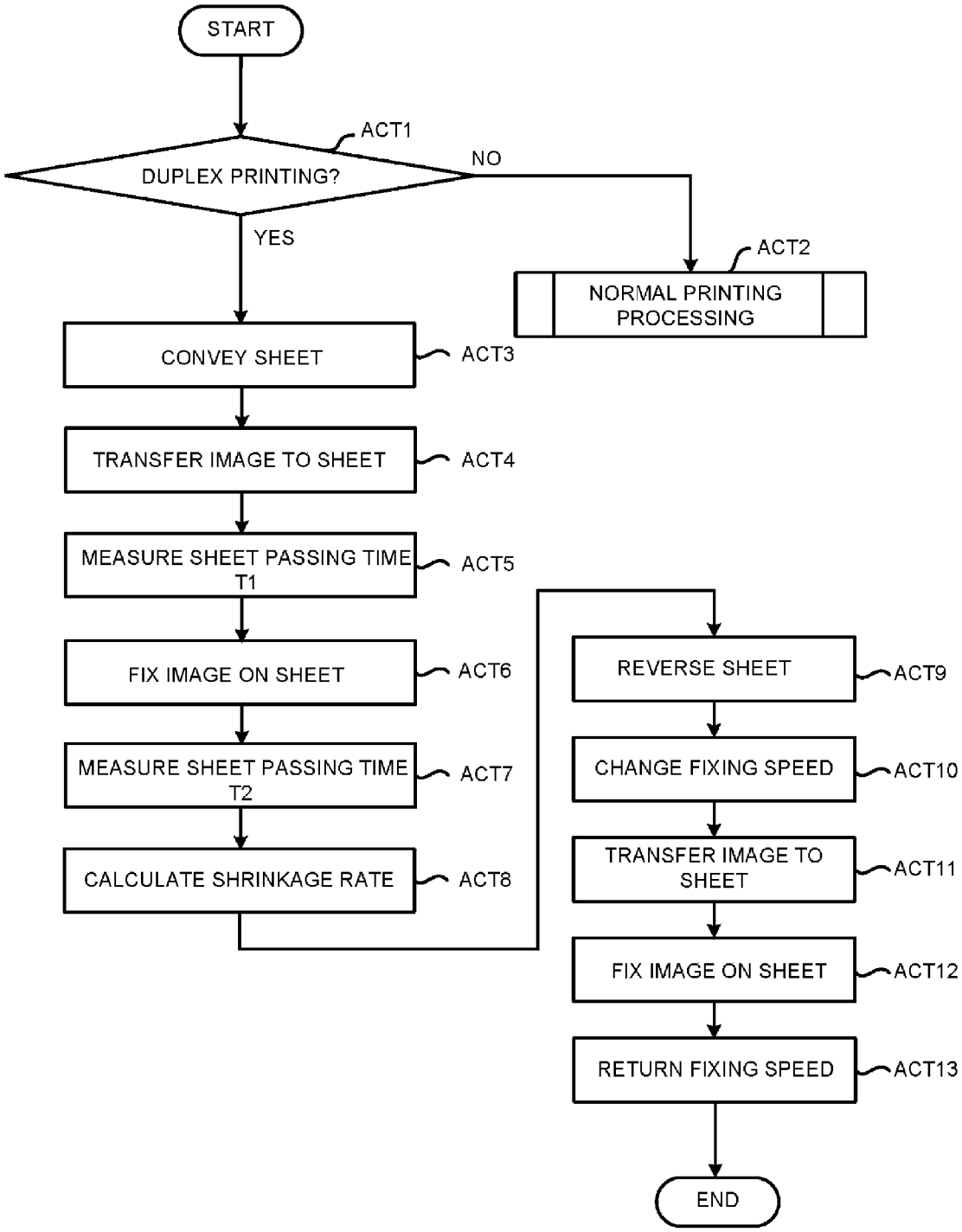
FIG. 7 is a flowchart illustrating part of other processing carried out in the image forming apparatus.

Next, part of the processing carried out in the image forming apparatus 100 is described with reference to FIG. 7. FIG. 7 is a flowchart illustrating part of the processing carried out in the image forming apparatus 100. The image forming apparatus 100 repeatedly executes the processing shown in FIG. 7.

The panel control section 101 determines whether or not duplex printing is instructed through the operation section 103 (ACT 1). The duplex printing refers to carrying out printing on the second surface of the sheet S after carrying out printing on the first surface of the sheet S. The panel control section 101 outputs the determination result to the printer control section 301 through the main control section 401.

In a case in which it is determined that the duplex printing is not instructed (NO in ACT 1), the printer control section 301 executes normal printing processing (ACT 2).

In a case in which it is determined that the duplex printing is instructed (YES in ACT 1), the printer control section 301 executes duplex printing processing. Hereinafter, the duplex printing processing is described.

The printer control section 301 takes the sheet S out from the sheet storage section 4 and conveys the sheet S along the conveyance path 5 (ACT 3). Herein, the printer control section 301 takes out and conveys the sheet S corresponding to the set size from the sheet storage section 4.

The printer control section 301 controls the image forming section 20 and the exposure device 31 to form the toner images corresponding to the image to be printed on the first surface on the surfaces of the photoconductors 21B, 22B, 23B and 24B. The toner images formed on the surfaces of the photoconductors 21B, 22B, 23B and 24B are primarily transferred to the intermediate transfer belt 11. Then the toner image on the intermediate transfer belt 11 is secondarily transferred to the sheet S at the transfer position 5A (ACT 4).

Then the sheet S that passed through the transfer position 5A passes through the pre-fixing sensor 63. The printer control section 301 calculates the sheet passing time T1 of the sheet S based on the ON signal input from the pre-fixing sensor 63 (ACT 5).

The sheet S that passed through the pre-fixing sensor 63 passes through the fixing position of the fixing device 6. The fixing device 6 applies heat and pressure to the sheet S passing through the fixing position to fix the toner image on the sheet S (ACT 6).

Next, the sheet S that passed through the fixing position passes through the post-fixing sensor 64. The printer control section 301 calculates the sheet passing time T2 of the sheet S based on the ON signal input from the post-fixing sensor 64 (ACT 7).

Then the printer control section 301 calculates the shrinkage rate based on the sheet passing times T1 and T2 of the sheet S (ACT 8). For example, the printer control section 301 substitutes the sheet passing times T1 and T2 into a formula (1) shown below to calculate the shrinkage rate.

$$\text{shrinkage rate}=(T2-T1)/T2 \qquad \text{Formula (1):}$$

Next, the printer control section 301 controls the reversal unit 8 and the like to reverse the sheet S (ACT 9).

The printer control section 301 changes the rotation speed of the fixing driving roller 61 according to the shrinkage rate calculated in ACT 8 (ACT 10). For example, the printer control section 301 determines the rotation speed corresponding to the shrinkage rate by reference to the shrinkage rate table. The printer control section 301 controls the motor control section 601 to rotate the fixing driving roller 61 at a rotation speed corresponding to the shrinkage rate. The motor control section 601 drives the motor 602 under the control of the printer control section 301. In this way, the fixing driving roller 61 is rotated at a rotation speed corresponding to the shrinkage rate.

The printer control section 301 controls the image forming section 20 and the exposure device 31 to form the toner images corresponding to the image to be printed on the second surface on the surfaces of the photoconductors 21B, 22B, 23B and 24B. The toner images formed on the surfaces of the photoconductors 21B, 22B, 23B and 24B are primarily transferred to the intermediate transfer belt 11. Then the toner image on the intermediate transfer belt 11 is secondarily transferred to the sheet S at the transfer position 5A (ACT 11).

The sheet S that passed through the transfer position 5A passes through the fixing position of the fixing device 6. The fixing device 6 applies heat and pressure to the sheet S passing through the fixing position to fix the toner image on the sheet S (ACT 12).

Then the printer control section 301 returns the rotation speed of the fixing driving roller 61 to the original speed (ACT 13).

As stated above, the printer control section 301 of the image forming apparatus 100 according to the embodiment changes the rotation speed of the fixing driving roller 61 in a case of carrying out printing on the second surface based on the shrinkage rate of the sheet S before and after the passing of the sheet through the fixing device 6. For example, the printer control section 301 slows down the rotation speed of the fixing driving roller 61 in a case of printing on the second surface according to the shrinkage rate in the process of printing on the first surface. Through such a constitution, the magnification of the image to be printed on the second surface can be reduced. Thus, the difference in the image magnification between the image on the first surface and the image on the second surface can be reduced when the thermally shrunk sheet S returns to the original size.

In the embodiment, the present invention is applied to the duplex printing; however, the present invention may also be applied to a case of superimposing and printing a plurality of images on a single side. In this case, the printer control section 301 slows down the rotation speed of the fixing driving roller 61 in a case of carrying out the second and the following printing according to the shrinkage rate of the sheet S in the first printing process.

The image forming apparatus 100 according to the embodiment is provided with an acquisition section for acquiring the size of the sheet S passing through the fixing device 6 according to the conveyed sheet S. Through such a constitution, the image forming apparatus 100 can measure the change in the size of the sheet S with high precision.

In the embodiment, the pre-fixing sensor 63 and the post-fixing sensor 64 are described as examples of the acquisition section. However, the acquisition section is not limited to this. For example, the pre-fixing sensor 63 may be omitted. In this case, the printer control section 301 calculates the shrinkage rate with the input size of the sheet S. For example, the printer control section 301 inputs the size of the sheet S from a personal computer connected with the printer control section 301 or the panel control section 101. Further, in a case in which the shrinkage rate corresponding to the size of the sheet S is determined in advance, the post-fixing sensor 64 or both the pre-fixing sensor 63 and the post-fixing sensor 64 may also be omitted.

The image forming apparatus 100 according to the embodiment is provided with the pre-fixing sensor 63 and the post-fixing sensor 64. The printer control section 301 calculates the shrinkage rate based on the detection result of the pre-fixing sensor 63 and the detection result of the post-fixing sensor 64. Through such a constitution, the image forming apparatus 100 can calculate the shrinkage rate of the sheet S that passed through the fixing device 6 with high precision.

In addition, the image forming apparatus 100 according to the embodiment is not limited to this. For example, in a case in which the shrinkage rate corresponding to the size of the sheet S is determined in advance, there is no need to calculate the shrinkage rate for each sheet S.

The printer control section 301 according to the embodiment calculates the shrinkage rate based on the sheet passing time T1 measured by the pre-fixing sensor 63 and the sheet passing time T2 measured by the post-fixing sensor 64. However, the present invention is not limited to this. For example, the printer control section 301 may calculate a length L1 of the sheet S in the conveyance direction based on the conveyance speed of the sheet S and the time T1 detected by the pre-fixing sensor 63. Further, the printer control section 301 may calculate a length L2 of the sheet S in the conveyance direction based on the conveyance speed of the sheet S and the time T2 detected by the post-fixing sensor 64. Then the printer control section 301 substitutes the lengths L1 and L2 into a formula (2) shown below to calculate the shrinkage rate.

$$\text{shrinkage rate}=(L2-L1)/L2 \qquad \text{Formula (2):}$$

Through such a constitution, the calculated shrinkage rate can be made more approximate to the shrinkage rate shown in FIG. 6.

In the image forming apparatus 100 according to the embodiment, the fixing device 6 is arranged at a position higher than the transfer position 5A. The sheet S is conveyed upwards in a vertical direction from the transfer position 5A to the fixing device 6. Through such a constitution, the conveyance speed of the fixing device 6 is slowed down, in this way, the force that presses the sheet S towards the direction of the transfer position 5A is generated easily. Thus, the conveyance speed of the sheet S at the transfer position 5A is slowed down, in this way, the image transferred to the sheet S at the transfer position 5A can be shrunk.

In the image forming apparatus 100 according to the embodiment, the fixing device 6 is provided with the fixing driven roller 62 which is pressed against the fixing driving roller 61 at a given pressure by a pressing mechanism (not shown). That is, the fixing driven roller 62 is independent from the fixing driving roller 61 without being connected with the fixing driving roller 61 through a gear and the like. Through such a constitution, the force that presses the sheet S towards the direction of the transfer position 5A is generated easily by slowing down the conveyance speed of the fixing device 6. Through the force, the conveyance speed of the sheet S at the transfer position 5A is slower than the intermediate transfer belt 11. In this way, the conveyance speed of the sheet S at the transfer position 5A is slowed down, and thereby the image transferred to the sheet S at the transfer position 5A can be shrunk.

In the image forming apparatus 100 according to the embodiment, the printer control section 301 controls the rotation speed of the fixing driving roller 61 in the second and the following fixing processing to be slower than the rotation speed of the fixing driving roller 61 in the first fixing processing. Through such a constitution, the difference in the image magnification between the first printed image and the second printed image can be reduced.

The image forming apparatus 100 according to the embodiment is provided with a reversal device (reversal unit 8) for reversing the sheet S that passed through the fixing device 6 and returning the sheet S to the fixing device 6 again. Through such a constitution, in a case of duplex printing, the difference in the image magnification between the image printed on the first surface and the image printed on the second surface can be reduced.

In the image forming apparatus 100 according to the embodiment, the printer control section 301 calculates a shrinkage rate when the sheet S passes through the fixing device 6 initially as the shrinkage rate. That is, the printer control section 301 does not calculate the shrinkage rate when the sheet S passes through the fixing device 6 for the second and subsequent time. Through such a constitution, the printer control section 301 can reduce the difference in the image magnification with the image formed on the sheet S initially.

In the image forming apparatus 100 according to the embodiment, the pre-fixing sensor 63 detects the sheet passing time of the sheet S passing through a given position at the upstream side of the fixing device 6 in the flow of the sheet S conveyed in the conveyance path 5. Through such a constitution, the size of the sheet S before the sheet S is thermally shrunk by the fixing device 6 can be measured correctly.

In the image forming apparatus 100 according to the embodiment, the post-fixing sensor 64 detects the sheet passing time of the sheet S passing through a given position which is immediately after the fixing device 6 in the flow of the sheet S conveyed in the conveyance path 5. Through such a constitution, the processing time for the printer control section 301 to calculate the shrinkage rate can be guaranteed sufficiently.

The image forming apparatus 100 according to the embodiment is not limited to this. For example, the post-fixing sensor 64 may be arranged at a given position at the downstream side of the fixing device 6 in the conveyance path 5. For example, the post-fixing sensor 64 may be arranged immediately in front of the inlet of the reversal unit 8, immediately after the outlet of the reversal unit 8 or inside the reversal unit 8.

In addition, though the image forming apparatus 100 which fixes the toner image on the sheet is exemplified, an inkjet type image forming apparatus can also be used.

Moreover, the size and the position of each roller can be changed randomly.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a fixing device configured to be provided with a fixing roller for conveying a sheet;

a control section configured to change, according to a shrinkage rate of the sheet before and after a first fixing processing of the sheet through the fixing device, the rotation speed of the fixing roller in a second fixing processing and at least one subsequent fixing processing carried out by the fixing device in a case in which the same sheet passes through the fixing device more than twice;

an acquisition section configured to acquire a size of the sheet passing through the fixing device according to the conveyed sheet;

wherein the control section controls the rotation speed of the fixing roller in the second fixing processing and the at least one subsequent fixing processing to be slower than the rotation speed of the fixing roller in the first fixing processing;

wherein the control section calculates the shrinkage rate when the sheet passes through the fixing device initially;

a panel control section configured to determine whether duplex printing is instructed through an operation section, the duplex printing comprising carrying out printing on a second surface of the sheet after carrying out printing on a first surface of the sheet;

wherein when the panel control section determines that duplex printing is not instructed, the control section executes a normal printing process; and wherein the control section stores information indicating the shrinkage rate of the sheet, the information corresponding to a conveyance speed of the sheet.

2. The image forming apparatus according to claim 1, further comprising:

a pre-fixing sensor configured to detect the sheet that is to pass through the fixing device; and a post-fixing sensor configured to detect the sheet that passed through the fixing device; wherein the control section calculates the shrinkage rate based on a detection result of the pre-fixing sensor and a detection result of the post-fixing sensor.

3. The image forming apparatus according to claim 1, wherein the fixing device is arranged at a position higher than a transfer position where an image is transferred to the sheet, and the sheet conveyed form the transfer position towards the fixing device is conveyed upwards in a vertical direction.

4. The image forming apparatus according to claim 1, further comprising:

a reversal device configured to reverse the sheet that passed through the fixing device and return the sheet to the fixing device again.

5. The image forming apparatus according to claim 1, further comprising:

a pre-fixing sensor configured to detect a sheet passing time of the sheet passing through a given position at the upstream side of the fixing device in the flow of the conveyed sheet.

6. The image forming apparatus according to claim 1, further comprising:

a post-fixing sensor configured to detect a sheet passing time of the sheet passing through a given position which is immediately after the fixing device in the flow of the conveyed sheet.

7. An image forming method, including:

changing, according to a shrinkage rate of a sheet before and after the passing of the sheet through a fixing device, the rotation speed of a fixing roller in the second and the following fixing processing carried out by the fixing device in a case in which the same sheet passes through the fixing device more than twice.

* * * * *